US009496667B2

(12) United States Patent
Gardner

(10) Patent No.: US 9,496,667 B2
(45) Date of Patent: Nov. 15, 2016

(54) ELECTRICAL HARNESS CONNECTOR SYSTEM WITH DIFFERENTIAL PAIR CONNECTION LINK

(71) Applicant: Molex, LLC, Lisle, IL (US)
(72) Inventor: Michael J. Gardner, Geneva, IL (US)
(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/413,200

(22) PCT Filed: Jul. 23, 2013

(86) PCT No.: PCT/US2013/051685
§ 371 (c)(1),
(2) Date: Jan. 6, 2015

(87) PCT Pub. No.: WO2014/018533
PCT Pub. Date: Jan. 30, 2014

(65) Prior Publication Data

US 2015/0155670 A1 Jun. 4, 2015

Related U.S. Application Data

(60) Provisional application No. 61/674,466, filed on Jul. 23, 2012.

(51) Int. Cl.

| | |
|---|---|
| ***H01R 31/06*** | (2006.01) |
| ***H01R 13/52*** | (2006.01) |
| ***H01R 13/6581*** | (2011.01) |
| ***H01R 9/03*** | (2006.01) |
| ***H01R 13/518*** | (2006.01) |
| ***H01R 13/6463*** | (2011.01) |
| ***H01R 13/514*** | (2006.01) |

(52) U.S. Cl.
CPC ..... *H01R 31/06* (2013.01); *H01R 9/035* (2013.01); *H01R 13/514* (2013.01); *H01R 13/518* (2013.01); *H01R 13/5208* (2013.01); *H01R 13/6463* (2013.01); *H01R 13/6581* (2013.01)

(58) Field of Classification Search
CPC H01R 13/6463; H01R 13/518; H01R 9/035; H01R 9/06; H01R 13/5208; H01R 13/6581
USPC ..... 539/502
See application file for complete search history.

(56) References Cited

U.S. PATENT DOCUMENTS

| | | | |
|---|---|---|---|
| 4,126,935 A | 11/1978 | Rhines et al. | |
| 5,222,898 A | 6/1993 | Fedder et al. | |

(Continued)

FOREIGN PATENT DOCUMENTS

| | | | | |
|---|---|---|---|---|
| DE | 19739503 A1 * | 3/1999 | ..... | H01R 13/4361 |
| JP | 2003-217358 A | 7/2003 | | |
| JP | 2004-063360 A | 2/2004 | | |
| JP | 2004-071404 A | 3/2004 | | |
| JP | 2008-041287 A | 2/2008 | | |
| JP | 2010-272366 A | 12/2010 | | |
| WO | WO 2009017186 A1 * | 2/2009 | ..... | H01R 9/035 |

*Primary Examiner* — Briggitte R Hammond
(74) *Attorney, Agent, or Firm* — Clarence R. Moon

(57) ABSTRACT

An electrical connector system includes a plug connector and a receptacle connector, each of which include a plurality of terminal receiving cavities for receiving a plurality of terminal lead wires. The electrical connector system further includes a connector link comprising a twisted pair differential cable for providing a data rate high data rate signal transmission transfer with the connector system, in addition to standard power and signal transmission, wherein the connector link is modularly connected within the electrical connector system.

22 Claims, 12 Drawing Sheets

(56) References Cited

U.S. PATENT DOCUMENTS

| | | | | |
|---|---|---|---|---|
| 5,314,356 | A * | 5/1994 | Isohata | H01R 13/6456 439/680 |
| 5,664,967 | A | 9/1997 | Hatagishi et al. | |
| 6,558,204 | B1 | 5/2003 | Weatherley | |
| 6,780,069 | B2 | 8/2004 | Scherer et al. | |
| 7,867,033 | B2 * | 1/2011 | Kumagai | H01R 13/719 439/620.01 |
| 2004/0023552 | A1 | 2/2004 | Chen | |
| 2009/0095501 | A1 | 4/2009 | Toyama | |
| 2010/0062643 | A1 | 3/2010 | Kumagai et al. | |

* cited by examiner

ELECTRICAL HARNESS CONNECTOR SYSTEM WITH DIFFERENTIAL PAIR CONNECTION LINK

REFERENCE TO RELATED APPLICATIONS

The Present Disclosure claims priority to prior-filed U.S. Provisional Patent Application No. 61/674,466, entitled "Differential Pair Link For Ethernet Automotive Harness Wiring," filed on 23 Jul. 2012 with the United States Patent And Trademark Office. The content of the aforementioned Patent Application is incorporated in its entirety herein.

BACKGROUND OF THE PRESENT DISCLOSURE

The Present Disclosure relates generally to the field of electrical connectors. In particular, the Present Disclosure relates to multi-conductor shielded and unshielded electrical connectors used in cable harnesses.

Today, traditional wire harness manufacturing presents a plurality of "single wires" terminated to a terminal. As is best illustrated in FIG. 1, a plurality of such single terminated wires are arranged and combined to form a bundled wire harness. In many instances, certain applications require high data rate transfer and use of a balanced, or impedance tuned, differential pair transmission link.

Currently, as best illustrated in FIGS. 2-4, in the single wire approach, a plurality of single terminated lead wires (in the example shown in the Figures, a pair) are inserted and retained within a connector housing, in adjacent terminal retention cavities. The pair of terminated wires are then twisted, creating a twisted differential pair. After this, the free ends of the twisted differential pair are then inserted and retained in the second connector in the same manner, completing this portion of the cable harness.

This approach is seen today with High Speed Controller Area Network and FlexRay technologies, which is labor intensive, as the twisting of the wire is performed after assembly into the connector cavity body and done so with inconsistent twist rate control which affect, inter alia, impedance control and, thereby, performance for higher speed technologies such as Ethernet or LVDS (Low Voltage Differential Signaling). To further complicate the assembly, each pair of terminals must be attached to the wire leads at both ends before the twist occurs, resulting in the potential imbalance of terminal presentation at the second (final) end of the twisted wire length prior to insertion in the connector. Either an untwisted length is required to allow each terminal to fit within its respective cavity, or the two terminals must be inserted at the same time (as a pair) to minimize this untwisted effect caused by the nature of the insertion process in traditional wire harness manufacturing.

In certain applications, further requirements such as moisture and debris prevention, the addition of seals further complicates this assembly and creates added difficulty in maintaining consistency, resulting in decreased assembly efficiency.

SUMMARY OF THE PRESENT DISCLOSURE

Grouping two terminals prior to termination allows the presentation of the grouped terminals to a termination station of a chosen termination process. Doing so allows for pre-twisted wires to be terminated at equal points of the cable length, assuring minimized skew between cable lengths. This grouped presentation also provides maximized balance between point-to-point ends of the cable termination. The end element of this grouped terminals and dual-ended twisted pair cable provides a tightly-managed, unitized terminated link that represents what has traditionally been provided by a single wire terminated at each end for wire harness manufacturing processes.

Accordingly, a connector system is provided used for connecting a wire harness. The connector system includes a first connector and a second connector for complete mechanical and electrical connection. In one embodiment, each connector link includes an unshielded twisted pair cable having unshielded sub-connector attached at respective ends of the twisted pair cable. The unshielded twisted pair cable, or connector link assembly, is introduced during the harness build process, and each sub-connector is retained in corresponding pockets formed in the first connector and second connector.

In a further embodiment, a connector system is provided for use in a wire harness assembly, and includes a first connector and second connector. A plurality of singularly terminated lead wire assemblies are retained in terminal receiving cavities in each respective connector. A shielded connector link comprising a jacketed twisted pair cable including an interleaved foil shield and a shielded sub-connector positioned at each end of the cable is similarly retained in each of the harness housings.

In a further embodiment, a connector system is provided that utilizes a connector link in a modular harness connector configuration. A plurality of individual connectors are interconnected within a wiring harness, and have a base connector with a series of first connectors interlocked to each other in an array. Each first connector has a single connector link, or multiple connector links depending on the specific requirement, with a plurality of traditional terminated single lead wire assemblies accompanying each connector links, which can also be connected to individual connectors or ganged connector arrays.

In alternative embodiments, the connector system is configured to be used in either a sealed or unsealed version. In such a case, each connector includes a wire seal or grommet secured to a terminated lead wire inserted to an accommodating cavity or chamber in a respective one of the connectors for the prevention of debris and moisture from entering the connector through the wire accommodating portion of each connector. A perimeter or interface seal may also be provided at the connecting interface between the first connector and the second connector. The perimeter seal is positioned on one of the connectors and, upon connecting the first connector with the second plug connector, a portion of the second connector overlaps the seal, creating a barrier and preventing debris and moisture and debris from entering the connector through the interface portion of the connector system.

To better understand the above-described objectives, characteristics and advantages of the Present Disclosure, embodiments, with reference to the drawings, are provided for detailed explanations.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
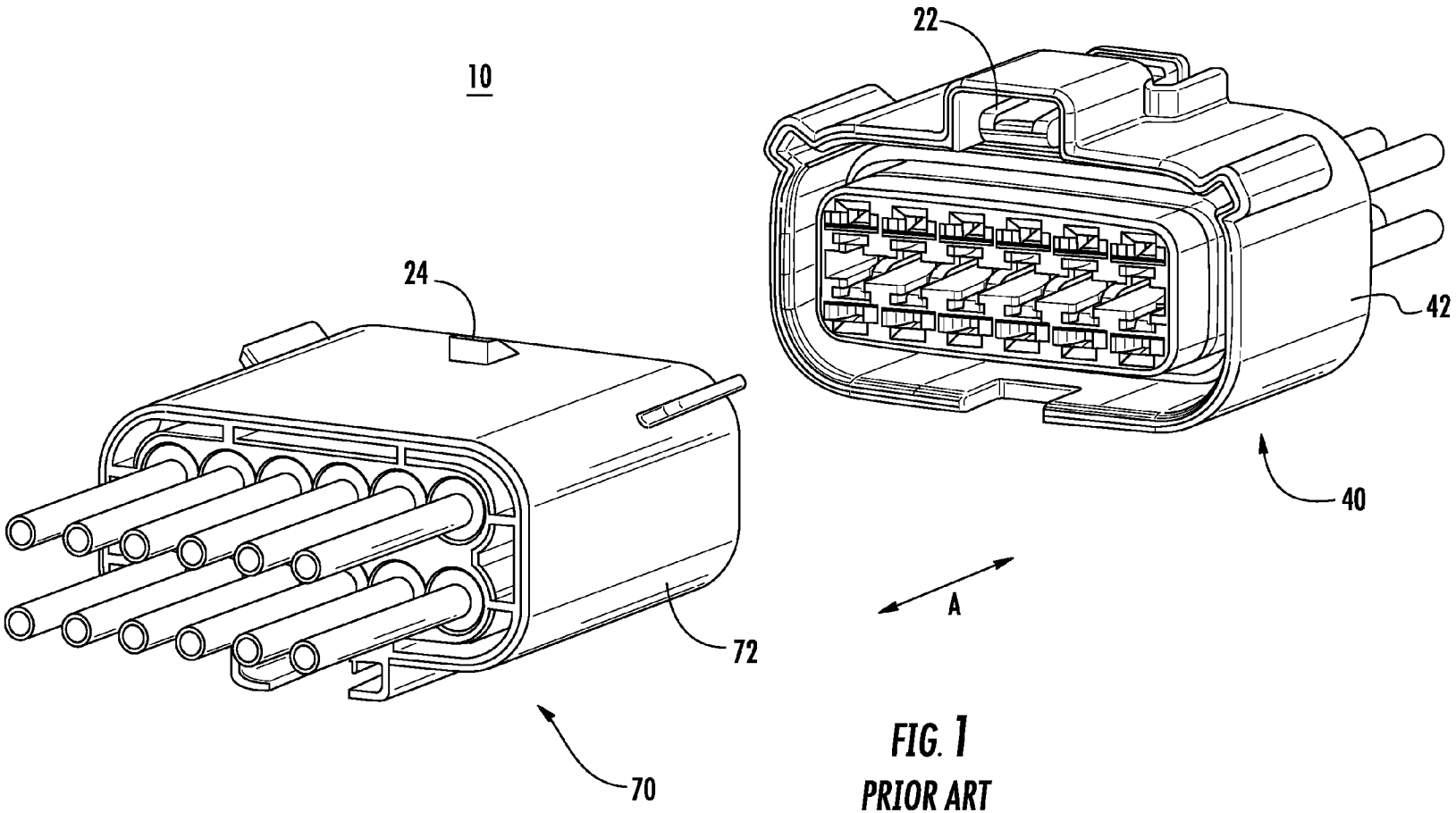
FIG. 1 PRIOR ART
FIG. 1 is a perspective view of a conventional wire-to-wire harness connector system.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

As shown in FIGS. 1-3 and 7-8, illustrating an embodiment of the Present Disclosure, a wire-to-wire connector system, or cable harness, 10 includes a first connector 40, typically a receptacle type connector, and a second connector 70, typically a plug type connector mateable along a Direction A. Although the preferred embodiment is illustrated as a wire-to-wire harness system, additional configurations may include a wire-to-board system, which includes a first connector mounted on a circuit board and the second connector attached to a multi-conductor cable, or any other system requiring a multi-conductor cable.

Each connector 40, 70 includes a plurality of cavities molded into the main body portions thereof. These cavities receive a plurality of male 1 and female 11 electrically conductive terminal leads. A connector link 100 having an impedance balanced cable pair—or typically, a twisted pair or twinax cable—110, including a sub-connector 120 at each end, is additionally received in a pocket 125 formed in each respective connector. A locking structure that includes a resiliently-deflecting locking member 22 is formed on one connector and selectively engageable with a locking projection 24 formed on the other connector for securing the connectors together when fully coupled.

The first connector 40 includes a housing 42 preferably molded from an electrical insulative material, and includes a main body portion 50, a front or mating portion 52 extending from one side of the main body portion 50 and a rear portion or terminal receiving portion 54 extending from an opposite side of the main body portion 50. The main body portion 50 includes a plurality of cavities or passages 60 formed therein for receiving a plurality of first electrically conductive terminals 12. The first electrically conductive terminals 12 are inserted through openings formed in the rear portion 54 of the housing 42 and retained in the housing 42 by a resilient spring finger 66. Corresponding openings 68 aligned with the terminal passages 60 are formed in the mating or front portion 52 of the housing 42 for receiving contact portions 7 of second electrically conductive terminals 2 retained in the second connector 70 therethrough for electrical engagement with the first terminals 12.

A second or receptacle connector 70 is similarly and preferably molded from an insulative material and configured to mate or receive the first connector 40 therein. The second connector 70 includes a main body portion 80, a front or mating portion 82 extending from one side of the main body portion 80 and a rear or terminal receiving portion 84 extending from an opposite side of the main body portion 80. The main body portion 80 includes a plurality of cavities or passages 90 formed therein for receiving a plurality of second electrically conductive terminals 2. The terminals are inserted through openings formed in the rear portion 84 of the receptacle connector housing 72 and similarly retained in the housing 72 by a resilient spring finger 98. The terminals are aligned with respective first conductive terminals of the plug connector 40 and, upon mating, make full electrical connection with the first electrically conductive terminals of the plug connector 10.

Figure 2:
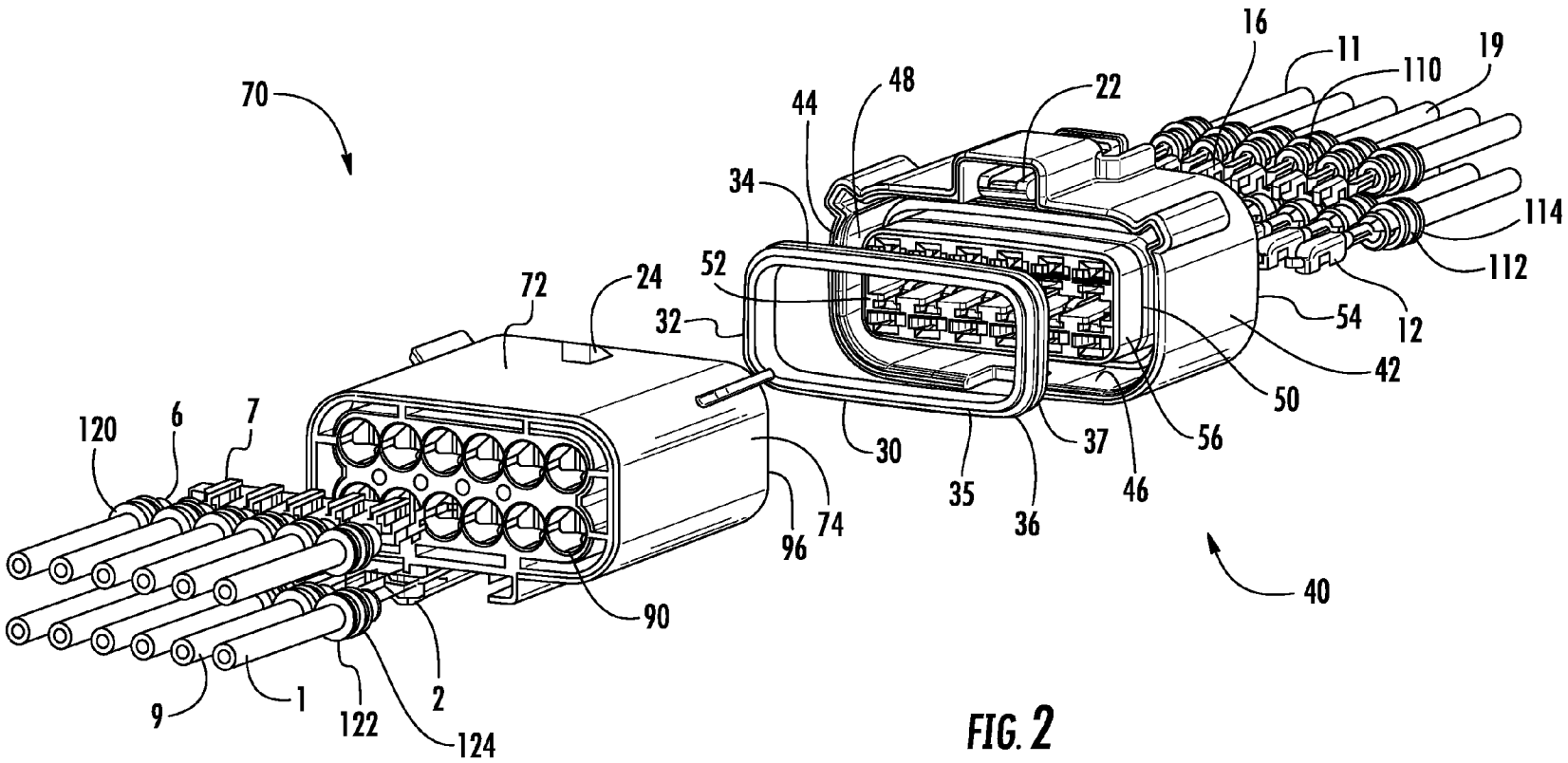
FIG. 2 PRIOR ART
FIG. 2 is an exploded perspective view of the connector system of FIG. 1.
Figure 3:
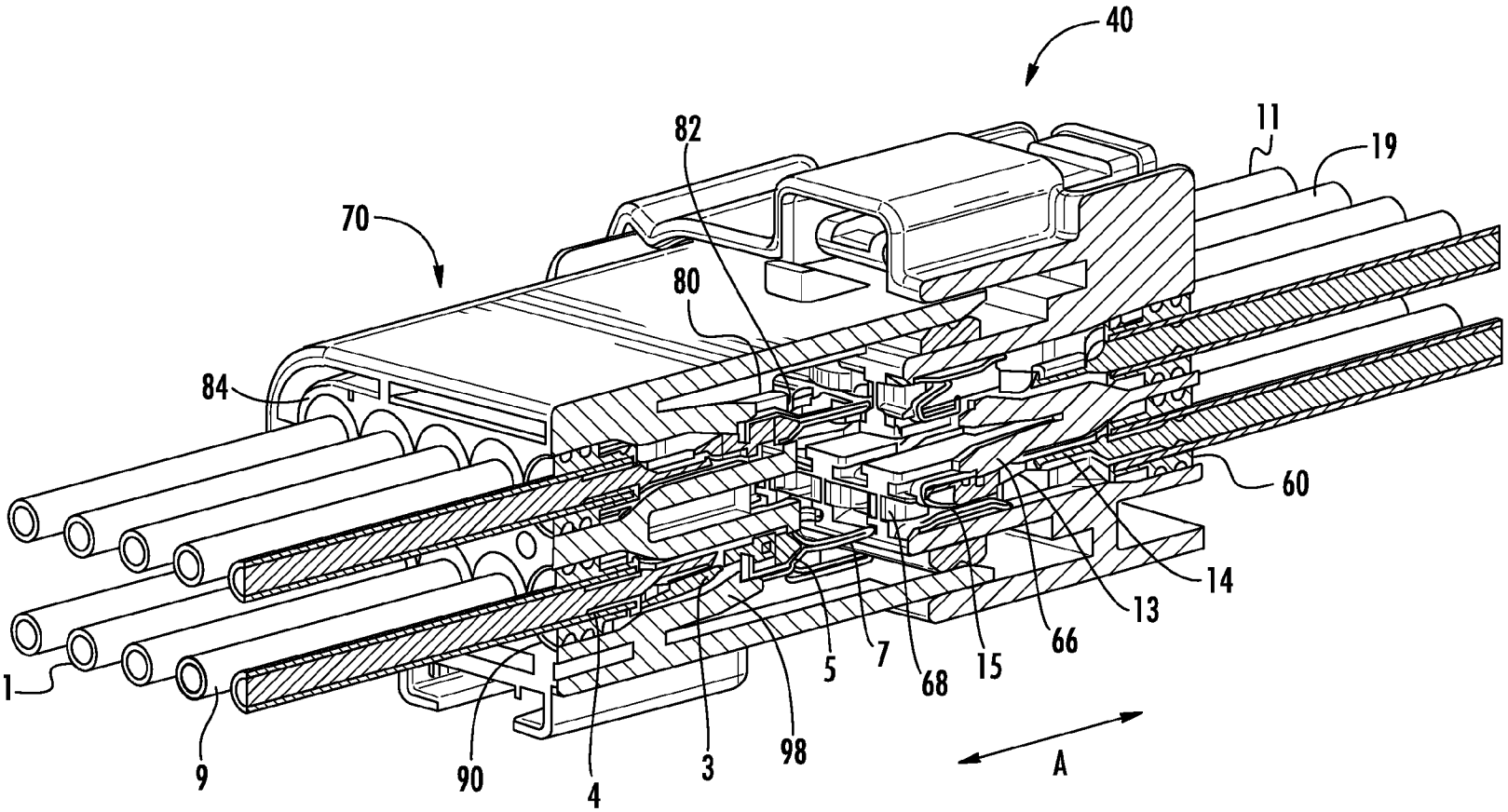
FIG. 3 PRIOR ART
FIG. 3 is a cross-sectional view of the connector system of FIG. 1.
Figure 4:
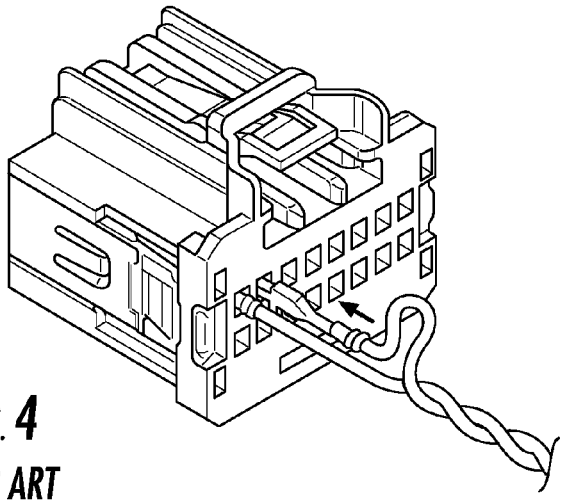
FIG. 4 PRIOR ART
FIG. 4 is a first detailed perspective view of a conventional connector of a wire-to-wire harness connector system.
Figure 5:
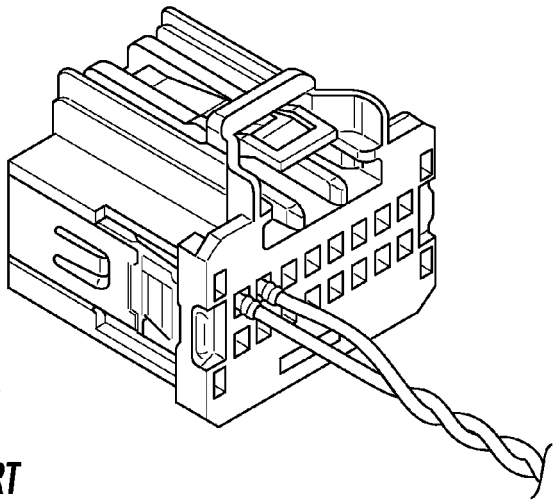
FIG. 5 PRIOR ART
FIG. 5 is a second detailed perspective view of the connector of FIG. 4.
Figure 6:
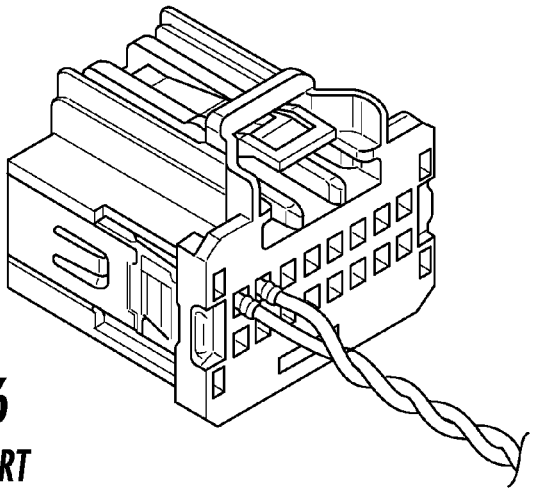
FIG. 6 PRIOR ART
FIG. 6 is a third detailed perspective view of the connector of FIG. 4.
Figure 7:
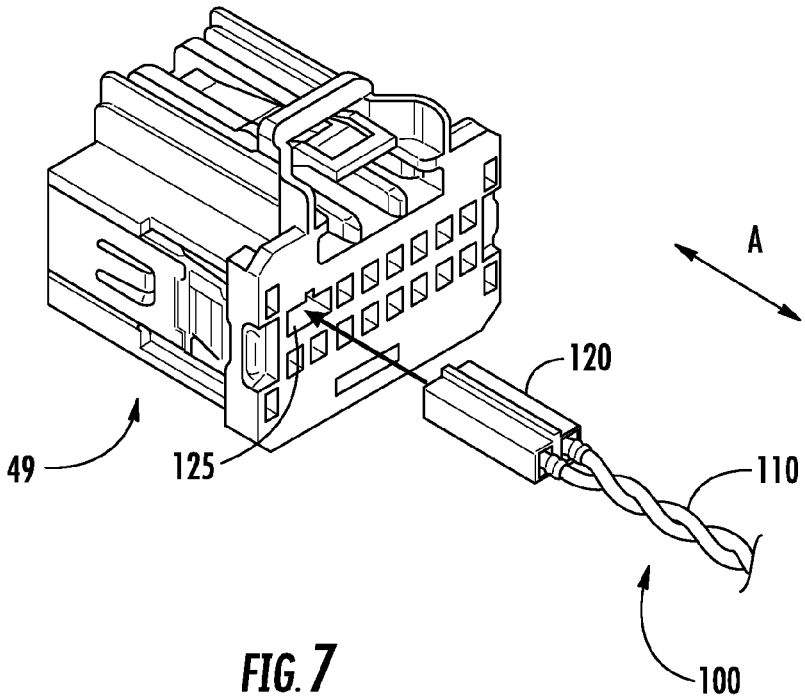
FIG. 7 is a first detailed perspective view of a connector of a wire-to-wire harness connector system of the Present Disclosure.

As best illustrated in FIGS. 2-3, each first electrically conductive terminal 12 is stamped and formed from an electrically conductive material. Each terminal 12 has a main body portion 13 with a wire receiving portion 14 formed at one end of the main body portion 13 and a mating end 15 extending from a second end of the main body portion 13 for electrical contact with a respective mating electrically conductive terminal 2. The wire receiving portion 14 has a crimp portion 16 for securing a lead wire 19 to the wire receiving end 14 of the first electrically conductive terminal 12 with the lead wire 19 extending rearwardly from the plug connector 40.

Each second electrically conductive terminal 2 is stamped and formed from an electrically conductive material such as copper or copper based alloy. Each terminal 2 has a main body portion 3 with a wire receiving portion 4 formed at one end of the main body portion 3 and a mating end 7 extending from a second end of the main body portion 3. The wire receiving portion 4 has a crimp portion 6 for securing a lead wire 9 to the wire receiving portion 4 of the electrical terminal 2 with the lead wire 9 extending rearwardly from the receptacle connector 70.

As previously noted and illustrated in FIGS. 7-10, the connector harness assembly 10 also includes a connector link 100 having a first sub-connector 120, a second sub-connector 122 and an impedance-balanced cable pair 110 connected to each sub-connector at respective ends. The first sub-connector 120 has a housing 121 preferably formed from an insulative material including a main body portion, a front mating portion 126 and a rear terminal receiving portion 128. The main body portion includes a pair of terminal receiving cavities 130 formed therein for receiving an electrically conductive terminal 132 in each cavity.

Similarly, each terminal 132 of the connector link 100 is preferably formed from an electrically conductive material. Each terminal 132 comprises a body portion, a contact portion at one end of the body portion and a securing end 134 formed at the other end of the body portion. The securing end 134 is formed with a securing portion for securing to an end portion of the one of the lead wires of the twisted pair cable 110. In the preferred embodiment, the terminal 132 is crimped to the wire, but any securing method may be used. As illustrated, each connector link 100 has a total of four terminals 132, a pair of terminals 132 crimped to each single wire of the twisted pair cable 110. A terminal is crimped to each end of the twisted pair cable 110.

Figure 10:
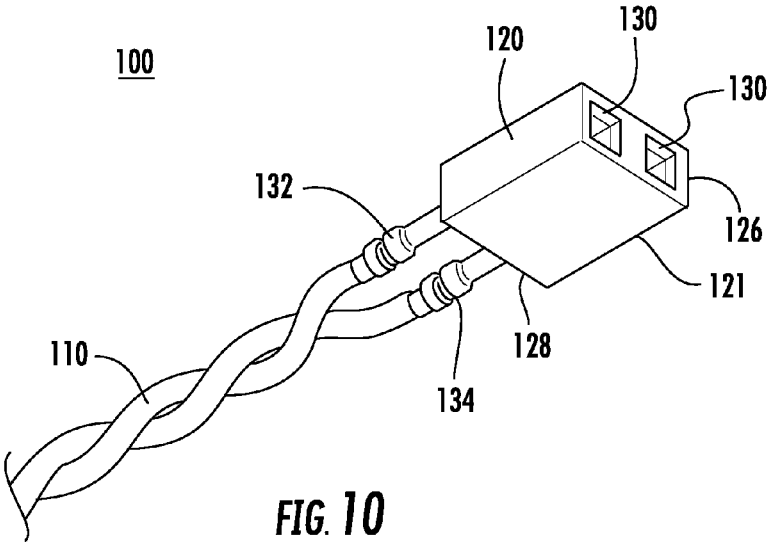
FIG. 10 is a detailed perspective view of the sub-connector of the connector link of the wire-to-wire harness connector system of the Present Disclosure.
Figure 11:
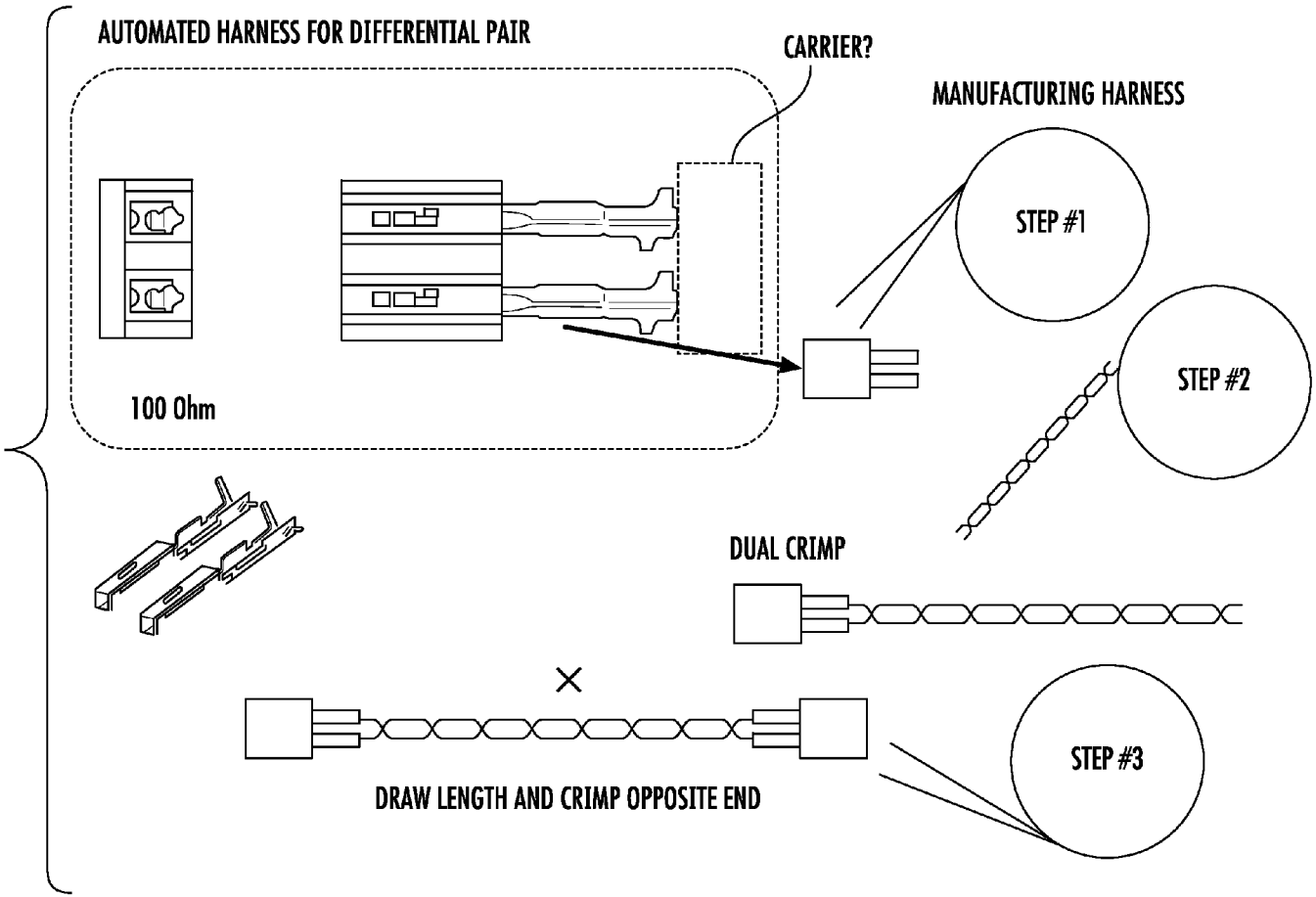
FIG. 11 is a schematic of the assembly process for producing the connector link of the wire-to-wire harness connector system of the Present Disclosure.

As best illustrated in FIG. 10, each sub-connector housing 121 includes a pair of terminal receiving cavities 130 molded therein. Each cavity 130 generally has a pocket or a deflectable spring finger (not shown) for securing respective terminals within the cavity 130. Alternatively, other methods may also be used to retain the terminals with their respective housings. In the preferred embodiment, spring retention fingers are formed on the main body portions of the terminal and upon insertion into the cavity and are locked within a recess or shoulder preventing the terminal from being withdrawn. With an automated or semi-automated assembly process, of which a schematic is illustrated in FIG. 11, the twisted pair cable is pre-twisted and terminated to each respective conductive terminal of the pair, allowing the complete connector link to be processed as a separate sub-assembly and produced off-line or shipped complete to the wire harness fabricators facility. The process of twisting the wires, crimping the terminals to each end of the wires and insertion into the insulative housing is fully automated and guarantees symmetry and balance to the connector link.

In the preferred embodiment, the connector system 10 is illustrated as having an unshielded connector link. In other words, the twisted pair cable 110 is sheathed but does not include an inner foil EMI shield. The preferred embodiment is utilized with an impedance- or electrically-balanced cable pair or twisted pair, but it should be noted that this includes various other balanced cable pairs, including twin-ax cables having two conductors, twisted quad cables and other high data rate cables having multi conductor cores. Consequently, the sub-connectors 120 are not required to have any shield, either.

Figure 12:
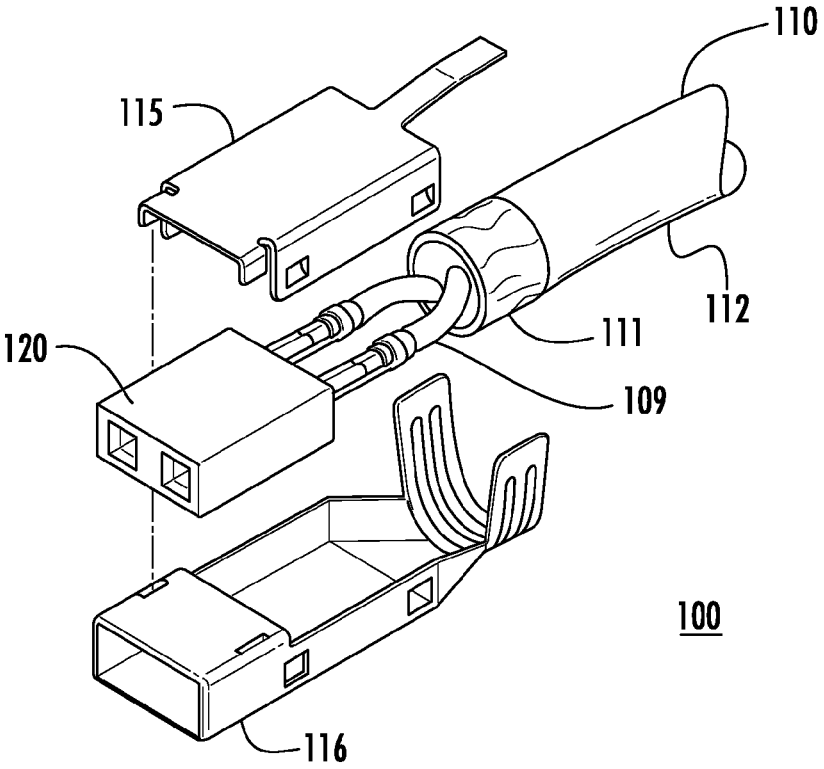
FIG. 12 is an exploded perspective view of an end of a shielded connector link of the wire-to-wire harness connector system of the Present Disclosure.
Figure 13:
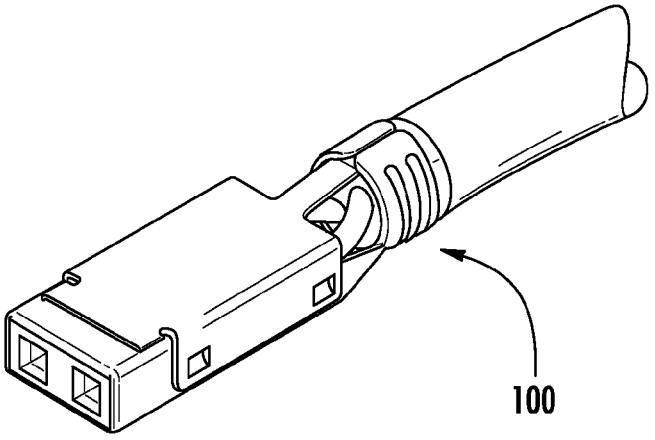
FIG. 13 is a perspective view of the shielded connector link of FIG. 12.
Figure 14:
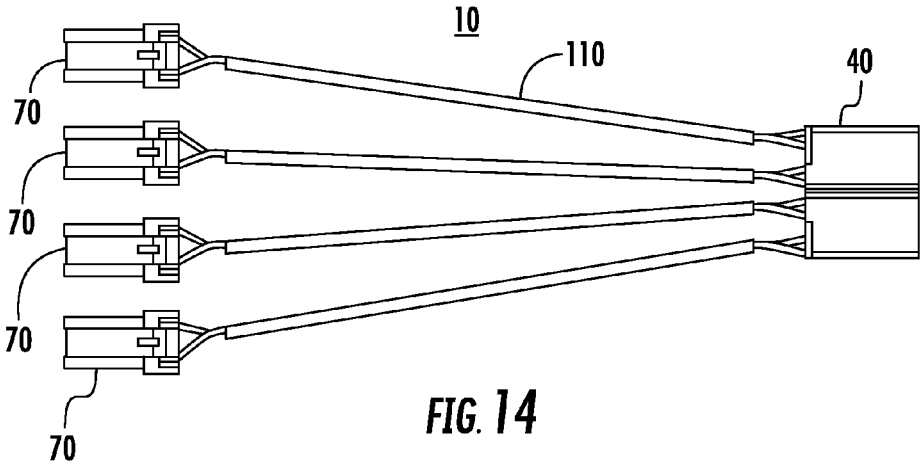
FIG. 14 is a plan view of a sub-harness portion of the wire-to-wire harness connector system of the Present Disclosure.
Figure 15:
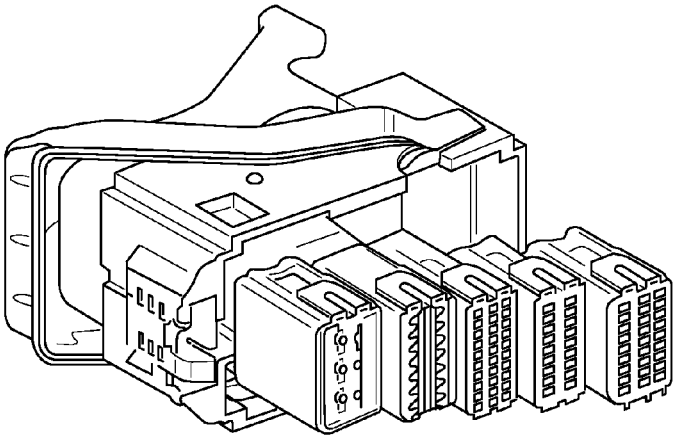
FIG. 15 is a perspective view of a modular holding assembly for the wire-to-wire harness connector system of the Present Disclosure.

In FIGS. 12-3, a shielded version is depicted, the twisted pair cable 110 including a conductive foil or braid 111 interleaved between the inner conductors 109 of the twisted pair cable 110 and the outer sheath 112. In addition to the foil or brad, a third drain wire may also be used to provide further grounding as required. Similarly, the inner conductive wires 109 are secured to the terminals 132 and inserted within the sub-connector 120. A stamped and form outer shield 115, 116 surrounds the insulative body of the sub-connector 120, and is connected in turn to the foil EMI layer 111 of the cable 110, providing a shielded electrical transmission channel.

Figure 16:
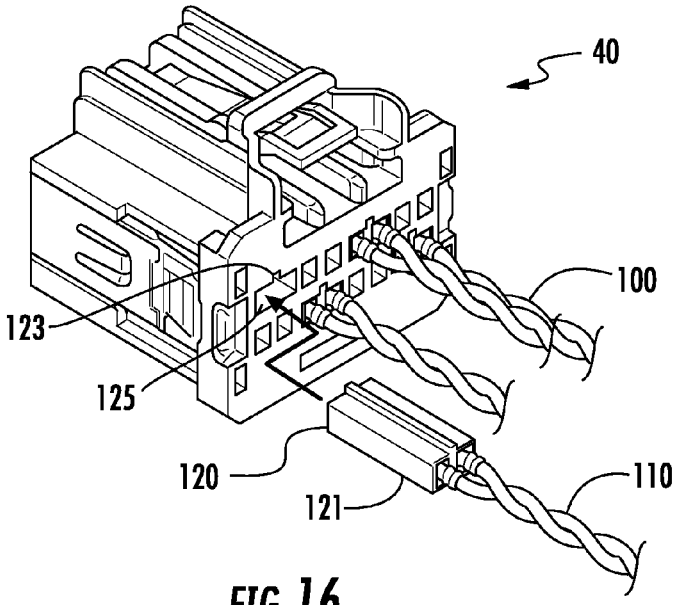
FIG. 16 is a third detailed perspective view of a connector of a wire-to-wire harness connector system of the Present Disclosure.

The connector assembly or harness 10 in its simplicity generally includes a first and second connector 40, 70, but may include a plurality of first and second connectors 40, 70. In the automotive industry, a typical connector harness runs throughout the entire vehicle branching out to transfer power and signal to all electrical peripheral devices and requires multiple independent harness assemblies. In certain instances, the high data rate transmission is required and the use of the above connector link accomplishes this. In these cases, the connector link (sometimes referred to as a data link) is incorporated into one or several of the vehicle harness branches, as illustrated in FIG. 16. The connector link 110 has a first end including a first sub-connector connected 40 to a first connector and a second end connected to the second sub-connector (not shown). In this instance, there are four connector links 110 retained in this harness portion 10. Other cavities include a plurality of single terminated lead wire assemblies (not shown) for carrying power and other signal transmissions.

During the assembly portion of the harness build process, the connector link 100 is provided as a complete sub-assembly and is introduced to the harness 10 by simply inserting respective sub-connectors 120 of the data link to appropriate positions in the harness end connectors 40, 70, as shown in FIG. 16. The value to this approach is that it provides either a shielded and unshielded solution in a differential pair configuration that can then be used like a normal unitized terminal in a traditional harness building process.

Each of the connectors 40, 70 of the harness 10 has a molded pocket 125 for receiving one of the ends of the sub-connector 120 for the connector link 100. Upon insertion into the receiving pockets 125 of the base connector 40, the sub-connector 120 of each connector link 100 is retained by a latch or alternative retaining mechanism used to securely hold each sub-connector 120 within the connector 40. Generally, a deflectable latch on either the sub-connector 120 or base connector 40 engages a shoulder or recess in the other connector not allowing the sub-connector 120 to be removed from the pocket in the base connector 40.

To properly align and guide the sub-connectors 120, each sub-connector 120 has a projection or rib 121 molded on the exterior of the housing so that each sub-connector 120 can be inserted into a slot 123 on the connector housing to maintain the correct position. Although the use of a rib 121 and slot 123 is shown to properly key the connector link to the housing, other methods can also be used. Alternatively the basic cross-sectional shape of the connector link housing 120 can also be used. Additionally, the different polarizations and keying options are be used within a connector to properly position multiple connector links 100 within each connector 40. This allows for proper polarity and continuity of the connector link 100 and additionally allows for any final adjustment to maintain balance and symmetry of the twisted pair cable 110. By fully engaging the sub-connectors 120 with the twisted pair cable 110 there cannot be any asymmetrical un-twisting. That is, any untwist or twisting happens simultaneously with the wire, therefore maintaining electrical balance, and any incidental un-twisting that may occur during handling can also be corrected according without loss of symmetry.

Figure 8:
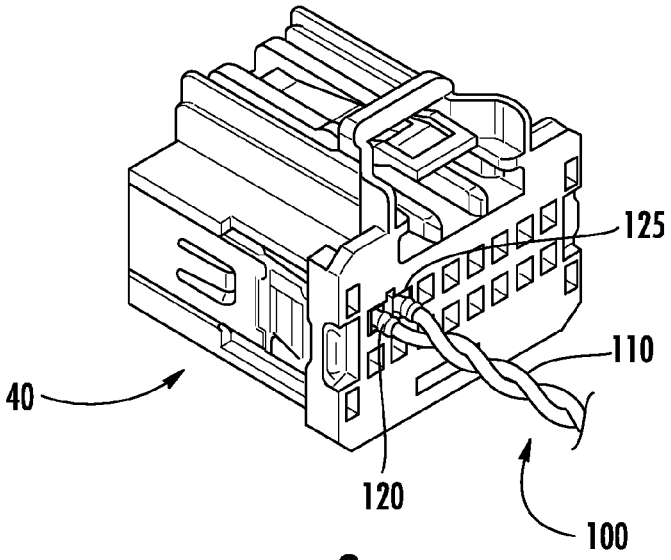
FIG. 8 is a second detailed perspective view of the connector of FIG. 7.
Figure 9:
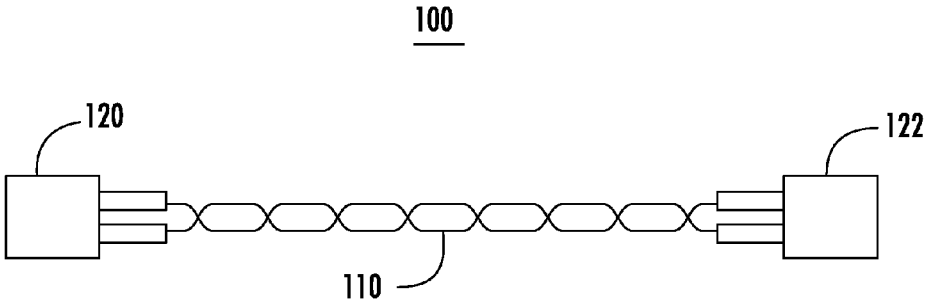
FIG. 9 is a schematic of a connector link of the wire-to-wire harness connector system of the Present Disclosure.
Figure 17:
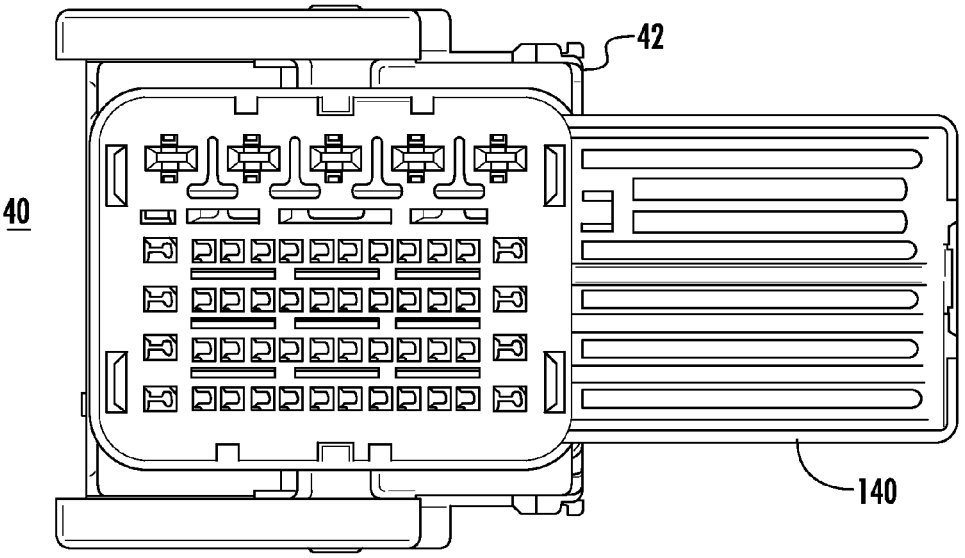
FIG. 17 is an plan view of the connector of FIG. 7-8 or 16.

Additionally, to assure that single terminated lead wire assemblies 1, 11 and connector links 100 are properly located and retained within each respective connector housing 40, 70, a Terminal Position Assurance (TPA) device, or Independent Secondary Lock (ISL) device, 140, as best shown in FIGS. 17-8, may be used to facilitate that the connector 40 is correctly assembled. The TPA/ISL 140 is typically mounted on the housing 42 in a first position with a releasable latch or other similar retaining mechanism. In this embodiment, the single terminated lead wire assemblies 11 are inserted into their respective cavities 60 and secured within the cavity 60. The connector link 100 is subsequently inserted into its defined pocket or recess 125 and similarly secured within its pocket 125.

After all of the terminated lead wire assemblies 11 and connector links 100 are positioned within the housing 942, the TPA/ISL 140 is then actuated. Generally, the TPA/ISL 140 is translated or moved to engage a cooperating feature on a terminal 12 or, in this embodiment, a terminal 12 and a sub-connector 120. This typically is a window, recess or shoulder, and is formed on each terminal and sub-connector housing. A post, boss or projection formed on the TPA/ISL 140 is received in the window or recess upon actuation of the TPA/ISL device 140 to a second final or locked position. If the TPA/ISL 140 cannot be moved to the second position, this triggers or provides a notification or detection that at least one of the terminals 12 or connector links 100 is not properly positioned within the connector housing 42 and the connector 40 should be inspected and further action is needed to adjust or fix the connector 40 so that is correctly assembled. Additionally, if the TPA/ISL 140 cannot be moved to its second position, it also prevents the first and second connectors 40, 70 of the harness assembly or connector system 10 from being completely connected together, a further indication that one of the connectors is not properly assembled.

Tuning the connector system can be accomplished by adjusting terminal to terminal spacing, and the impedance and crosstalk is directly affected by the distance between adjacent terminals. These terminals can be positioned within a multi-circuit connector or in a single sub-connector having at least a single pair of terminals. Additionally, in a connector system that has multiple rows of terminals, the distance between rows of terminals also affect electrical performance. For instance, in single row connectors, the only spacing between terminals is in a side-by-side orientation, so therefore, the distance between adjacent terminals have an effect of impedance and crosstalk. With multi-row connectors, not only side-by-side spacing affects the performance but row-to-row spacing and grouping between terminal to terminal spacing combined with row to row.

A single pair of wire termination assemblies can then be grouped in multiple single pair terminated assemblies to arrange for multiple lanes of differential pairs, as the technology demands. Having individual pairs allows for placement within a larger array at desired distance from other similar signal types, or those of an aggressive nature, allowing for minimizing signal cross-talk or any aggression signal influence on the differential pair.

Figure 19:
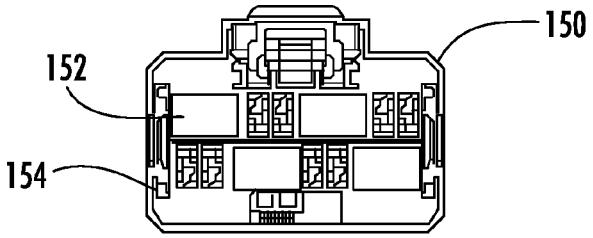
FIG. 19 is a plan view of a base connector of the wire-to-wire harness connector system of the Present Disclosure.
Figure 20:
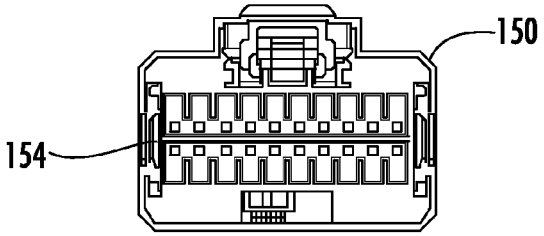
FIG. 20 is a plan view of an alternative base connector of the wire-to-wire harness connector system of the Present Disclosure.
Figure 21:
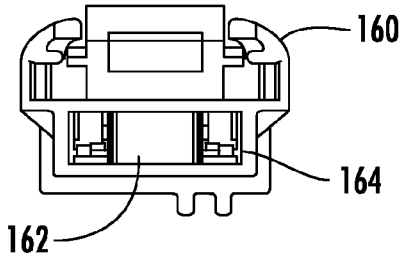
FIG. 21 is a plan view of a branch connector of the wire-to-wire harness connector system of the Present Disclosure.

In the present embodiment, a connector 40 comprises a plurality of single terminated lead wires 11 and one or more connector links 100 with a sub-connector 120 containing a single grouping of a pair of terminals 132. Depending on the modular configuration of the connector 40, various arrangements of terminated lead wire assemblies and connector links can be specified, all of which having a spacing between adjacent terminals or groups of terminals. For illustrative purposes, referring to FIGS. 19-21, a wire harness connector system 10 is contemplated using a sixteen circuit base connector 150 and four individual, single row four-circuit branch connectors 160. The sixteen circuit base connector 150 includes four receiving pockets 152 alternatively spaced for receiving one sub-connector 120 of the connector link 100 and the remaining circuit positions 154 reserved for single terminated lead wires 111.

Figure 23:
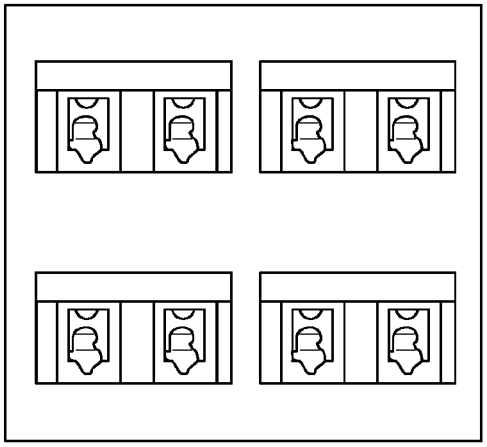
FIG. 23 is a schematic of an alternative base connector of the wire-to-wire harness connector system of the Present Disclosure.

The branch connectors 160 can include any combination of receiving pockets 162 and single cavities 164. For instance, one branch connector 160 can include two side-by side pockets 152 for receiving one or two sub-connectors 120 of a connector link 100. A second branch connector 160 may include a single centrally located receiving pocket 162 for the connector link and a single cavity 164 positioned exterior on each side of the connector link pocket 162, as specified in FIG. 23. A third arrangement includes a pair of side-by-side single cavities 164 and a single connector link pocket 162 of either side of the cavities and a fourth arrangement includes four individual single cavities 164.

Figure 22:
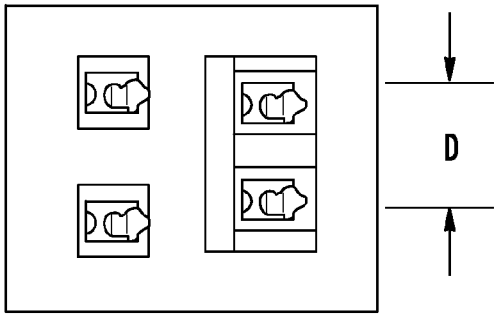
FIG. 22 is a schematic of a base connector of the wire-to-wire harness connector system of the Present Disclosure.

In all arrangements, and in particular the arrangement with the high data rate transmission, the signal must be tuned to optimize efficiency, balance and minimize crosstalk. For this illustration, this involves adjusting the side-to-side spacing in the branch connectors 160 and the combination of side-to-side and row-to-row in the base connector. As best shown in FIGS. 22-3, a spacing D exists between each terminal within the twisted pair sub-connector 120 of the connector link 100. The D dimension is determined to be that which maintains the closest proximity to adjacent terminals in the connector link and provides minimum crosstalk and or any aggression signal influence within the differential pair of the connector link 100. When a connector arrangement has a group of both single terminated leads 11 and connector link assemblies 100, the spacing is generally dictated by D, spacing within the connector link 100, thus spacing between adjacent single terminated leads 11 and connector links 100 should be at least D in a side-by-side orientation and at least D in a row-to-row orientation. In other arrangements, such as circular or polar orientations, the spacing along radial distances and diagonals should also maintain an at least D spacing.

In cases where protection from debris and/or moisture is required, the harness connector system incorporates a perimeter seal that prevents the debris and/or moisture from entering the connector system from the interface side of the assembly. Referring to FIGS. 2-3, a shroud or hood 44 surrounds a periphery of the main body portion 50 of the first housing 42 and forms an opening, or receiving space, 48 between an exterior surface 56 of the main body portion 50 of the housing 42 and an interior surface 46 of the shroud 44 for receiving a pliable elastomeric perimeter seal 30. The receiving space 48 formed between the main body portion 50 and the shroud or hood 44 accommodates a hood extension 74 formed in the second connector 70 that, upon mating, creates an overlap with the perimeter seal to provide a barrier from potential ingress of debris and/or moisture.

From the rear of the connector, wire seals or grommets 112 are used to prevent the ingress of debris and/or moisture from the terminating end by providing a seal between the wire and the housing cavity 60 where the lead assembly 11 is inserted to the housing 42. In the case where wire seals are used, a circular seal surrounds the wire in a tight registration and is crimped along with the wire to the crimp portion of the conductive terminal 1.

Figure 18:
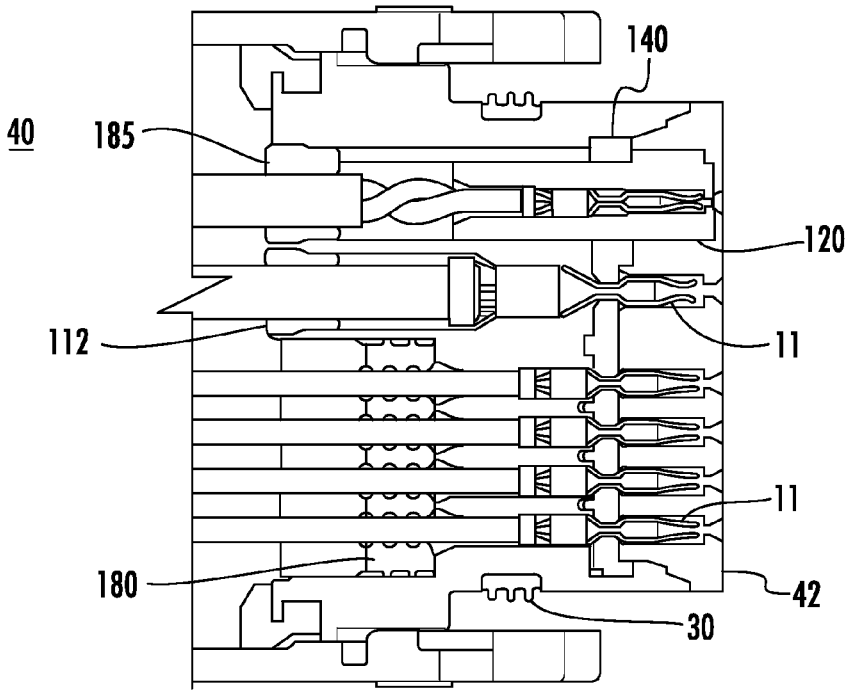
FIG. 18 is a cross sectional view of the connector of FIG. 17.

Shown in FIG. 18, in connectors where a large number of circuits are employed, a grommet or matt seal 180 can be used in place of individual wire seals 112. This typically involves a flat elastomeric material having a plurality of holes corresponding to the size and location of the terminals in the connector housing 42 and retained to the rear of the connector housing 42. Each wire lead assembly 11 passes through the grommet 180, and the fit between each respective hole in the grommet 18 and the lead wire assembly 11 prevents the debris and moisture from entering the connector 40 from the rear of the connector harness system 10. Additionally, each connector link 100 may be sealed by itself That is, the sub-connector 120 may also have a perimeter seal that interfaces with the connector 40 and/or a wire seal or grommet 185 to seal the connector link 100 from the wire terminating end. Alternatively, in some cases, a dispensed elastomer such as silicon can be applied to create a barrier around irregular areas to create a moisture proof passage were separate elastomeric seals are not feasible.

While a preferred embodiment of the Present Disclosure is shown and described, it is envisioned that those skilled in the art may devise various modifications without departing from the spirit and scope of the foregoing Description and the appended Claims.

What is claimed is:

1. A connector system, the connector system comprising:

a first connector, the first connector including a first housing, the first housing including at least one first terminal cavity and at least one first receiving pocket;

a second connector, the second connector including a second housing, the second housing including at least one second terminal cavity and at least one second receiving pocket;

at least one lead wire assembly, each lead wire assembly including a lead wire having a first end and a second end with a first electrically conductive terminal connected to the first end of the lead wire and a second electrically conductive terminal connected to the second end of the lead wire; and at least one connector link, each connector link including a first sub-connector, a second sub-connector and at least one twisted pair cable, the first sub-connector including at least one pair of first sub-connector cavities formed therein for receiving at least one first pair of electrically conductive terminals, the second sub-connector including at least one pair of second sub-connector cavities formed therein for receiving at least one second pair of electrically conductive terminals, each twisted pair cable having a first end and a second end, the first end of each twisted pair cable being connected to one of the first pairs of electrically conductive terminals, each second end of the twisted pair cable being connected to one of the second pairs of electrically conductive terminals;

wherein a first end of the lead wire assembly is retained in the first terminal cavity of the first connector and a second end of the lead wire assembly is retained in the second terminal cavity of the second connector, and wherein a first end of the connector link is retained in one of the first receiving pockets of the first connector and a second end of the connector link is retained in one of the second receiving pockets of the second connector.

2. The connector system of claim 1, wherein each first sub-connector is formed from an insulative material.

3. The connector system of claim 2, wherein each second sub-connector is formed from an insulative material.

4. The connector system of claim 1, wherein the first end of each twisted pair cable is received in one of the first sub-connector cavities.

5. The connector system of claim 4, wherein the second end of each twisted pair cable is received in one of the second sub-connector cavities.

6. The connector system of claim 5, wherein each first sub-connector includes a first structure mechanism to ensure proper alignment within the first connector.

7. The connector system of claim 6, wherein each second sub-connector includes a second structure mechanism to ensure proper alignment within the second connector.

8. The connector system of claim 1, wherein the placement of each twisted pair cable within the first sub-connector can be adjusted to optimize performance of the twisted pair cable.

9. The connector system of claim 8, wherein the placement of the first end of each connector link within one of the first receiving pockets of the first connector can be adjusted to optimize performance of the twisted pair cable.

10. The connector system of claim 1, wherein the placement of each twisted pair cable within the second sub-connector can be adjusted to optimize performance of the twisted pair cable.

11. The connector system of claim 10, wherein the placement of the second end of each connector link within one of the second receiving pockets of the second connector can be adjusted to optimize performance of the twisted pair cable.

12. The connector system of claim 1, wherein each first cavity receives a first conductive terminal.

13. The connector system of claim 12, wherein each second cavity receives a second conductive terminal.

14. The connector system of claim 13, further including at least one single-lead wire, each single-lead wire having a first end connected to one of the first conductive terminals and a second end connected to one of the second conductive terminals.

15. The connector system of claim 1, wherein the connector system is waterproof.

16. The connector system of claim 1, wherein portions of the connector system are designed to shield electromagnetic interference.

17. A connector system, the connector system comprising:

a first connector, the first connector including a first housing, the housing including a plurality of first terminal cavities and a plurality of first receiving pockets, wherein a first spacing is defined between adjacent first terminal cavities, and wherein a second spacing is defined between each first receiving pocket and an adjacent first terminal cavity;

a plurality of second connectors, each second connector including a housing, the housing including a plurality of second terminal cavities and at least one second receiving pocket, wherein a third spacing is defined between adjacent second terminal cavities, and wherein a fourth spacing is defined between each second receiving pocket and an adjacent second terminal cavity;

a plurality of lead wire assemblies, each lead wire assembly including a lead wire having a first end and a second end with an electrically conductive terminal connected to the first end of the lead wire and a second electrically conductive terminal connected to the second end of the lead wire; and a plurality of connector links, each connector link including a least one sub-connector and an impedance balanced cable pair, each sub-connector including a pair of third terminal cavities, wherein a fifth spacing is defined between the pair of third terminal cavities, wherein the pair of third terminal cavities are configured to receive a pair of electrically conductive terminals, the balanced cable pair having at least one end, each end of the balanced cable pair being connected to the pair of electrically conductive terminals;

wherein the second spacing is greater than the fifth spacing when the first end of the lead wire assembly is retained in the first terminal cavity and a second end of the lead wire assembly is retained in the second terminal cavity, and wherein a first end of the connector link is retained in one of the first receiving pockets and a second end of the connector link is retained in one of the second receiving pockets.

18. A connector system, the connector system comprising:

a first connector, the first connector including a first housing, the housing including a plurality of first terminal cavities and at least one first receiving pocket, wherein a first spacing is defined between adjacent first terminal cavities, and wherein a second spacing is defined between each first receiving pocket and an adjacent first terminal cavity;

a second connector, the second connector including a second housing, the second housing including a plurality of second terminal cavities and at least one second receiving pocket, wherein a third spacing is defined between adjacent second terminal cavities, and wherein a fourth spacing is defined between each second receiving pocket and an adjacent second terminal cavity;

at least one lead wire assembly, each lead wire assembly including a lead wire having a first end and a second end with an electrically conductive terminal connected to the first end of the lead wire and a second electrically conductive terminal connected to the second end of the lead wire; and at least one connector link, each connector link including a least one sub-connector and an impedance balanced cable pair, each sub-connector including a pair of third terminal cavities, wherein a fifth spacing is defined between the pair of third terminal cavities, wherein the pair of third terminal cavities are configured to receive a pair of electrically conductive terminals, the balanced cable pair having at least one end, each end of the balanced cable pair being connected to the electrically conductive terminals;

wherein the second spacing is greater than the fifth spacing when a first end of the lead wire assembly is retained in the first terminal cavity and a second end of the lead wire assembly is retained in the second terminal cavity, and wherein a first end of the connector link is retained in one of the first receiving pockets and a second end of the connector link is retained in one of the second receiving pockets.

19. The connector system of claim 18, wherein a terminal position assurance device is mounted on the first connector in a first position so that the lead wire assemblies can be inserted in the first terminal cavities and the connector links can be inserted into the first receiving pockets.

20. The connector system of claim 19, wherein the terminal position assurance device is moved to a second position so that the lead wire assemblies and the connector links are locked in the housing.

21. A connector system, the connector system comprising:

a first connector, the first connector including a housing, the housing including at least one receiving pocket;

a second connector, the second connector including a housing, the housing including at least one terminal cavity; and at least one connector link, the connector link including at least one sub-connector and at least one twisted pair cable, each sub-connector including a pair of terminal cavities formed therein for receiving a pair of electrically conductive terminals, each twisted pair cable having a first end having the electrically conductive terminals connected thereto and a second pair of electrically conductive terminals connected to the second end of each twisted pair cable;

wherein the sub-connector is received in the receiving pocket of the first connector and the second pair of electrically conductive terminals are received in the terminal cavities of the second connector.

22. A connector system, the connector system comprising:

a first connector, the first connector including a housing, the housing including at least one receiving pocket and at least one terminal cavity;

a second connector, the second connector including a housing, the housing including at least one second receiving pocket and at least one second terminal cavity; and at least one connector link, the connector link including at least one sub-connector and at least one impedance balanced cable pair, the sub-connector including a pair of terminal cavities formed therein for receiving a pair of electrically conductive terminals, the balanced cable pair having a first end having the pair of electrically conductive terminals connected thereto and a second pair of electrically conductive terminals connected to the second end of the twisted pair cable;

wherein the first connector receives one end of the connector link and the second connector receives another end of the connector link.

* * * * *